US012209371B2

(12) United States Patent
Sung et al.

(10) Patent No.: US 12,209,371 B2
(45) Date of Patent: Jan. 28, 2025

(54) LOW-PROFILE BARRIER AND CONSTRUCTING METHOD THEREOF

(71) Applicant: KOREA INSTITUTE OF CIVIL ENGINEERING AND BUILDING TECHNOLOGY

(72) Inventors: Jung-Gon Sung, Goyang-si (KR); Min Hyung No, Cheonan-si (KR); Duk-Geun Yun, Goyang-si (KR); Young Rok Kim, Goyang-si (KR); Chunjoo Yoon, Seoul (KR); Jaehong Park, Goyang-si (KR)

(73) Assignee: Korea Institute of Civil Engineering and Building Technology, Goyang-si (KR)

( * ) Notice: Subject to any disclaimer, the term of this patent is extended or adjusted under 35 U.S.C. 154(b) by 756 days.

(21) Appl. No.: 17/496,998

(22) Filed: Oct. 8, 2021

(65) Prior Publication Data

US 2022/0145559 A1 May 12, 2022

(30) Foreign Application Priority Data

Nov. 11, 2020 (KR) ..... 10-2020-0150027

(51) Int. Cl.
*E01F 15/08* (2006.01)

(52) U.S. Cl.
CPC ..... *E01F 15/088* (2013.01); *E01F 15/083* (2013.01)

(58) Field of Classification Search
CPC ..... E01F 15/088; E01F 15/12; E01F 15/083
See application file for complete search history.

(56) References Cited

U.S. PATENT DOCUMENTS

| | | | | |
|---|---|---|---|---|
| 3,980,279 | A * | 9/1976 | Bofinger | E01F 15/088 256/13.1 |
| 4,773,629 | A * | 9/1988 | Yodock | E01F 15/086 256/19 |
| 5,464,306 | A * | 11/1995 | Cristiano | E01F 15/083 404/6 |
| 5,882,140 | A * | 3/1999 | Yodock, Jr. | E01F 15/083 404/6 |
| 6,669,402 | B1 * | 12/2003 | Davis | E01F 15/088 404/6 |
| 8,079,774 | B2 * | 12/2011 | House | E01F 15/083 404/6 |
| 10,774,489 | B1 * | 9/2020 | Yodock, Jr. | E02B 3/108 |
| 2007/0098490 | A1 * | 5/2007 | Christensen | E01F 15/086 404/6 |

(Continued)

FOREIGN PATENT DOCUMENTS

| | | |
|---|---|---|
| EP | 0 641 893 B1 | 8/1997 |
| JP | H10-159008 A | 6/1998 |

(Continued)

*Primary Examiner* — Abigail A Risic
(74) *Attorney, Agent, or Firm* — Goldilocks Zone IP Law

(57) ABSTRACT

The present disclosure relates to a low-profile barrier including a plurality of segments continuously arranged in the longitudinal direction and a connecting member installed in a connection portion, the connection portion between the segments configured to bend in the horizontal direction in order to effectively absorb impacts in the event of a vehicle collision, thereby ensuring safety of vehicles and vehicle occupants, and a method for constructing the same.

4 Claims, 16 Drawing Sheets

(56) References Cited

U.S. PATENT DOCUMENTS

| | | | | |
|---|---|---|---|---|
| 2007/0243015 | A1* | 10/2007 | Yodock, III | E01F 15/088 404/6 |
| 2009/0041540 | A1* | 2/2009 | Yodock, III | E01F 15/088 404/6 |
| 2011/0229261 | A1* | 9/2011 | Redlberger | E01F 15/083 403/364 |
| 2012/0269574 | A1* | 10/2012 | Redlberger | E01F 15/083 404/6 |
| 2015/0218763 | A1* | 8/2015 | Smith | E01F 15/088 404/6 |
| 2017/0204576 | A1* | 7/2017 | Barnas | E01F 15/088 |
| 2022/0056654 | A1* | 2/2022 | Rico Arenal | E01F 15/0476 |

FOREIGN PATENT DOCUMENTS

| | | | | |
|---|---|---|---|---|
| JP | 2009-270332 | A | | 11/2009 |
| KR | 10-0595380 | B1 | | 6/2006 |
| KR | 10-2007-0090650 | A | | 9/2007 |
| KR | 20070090650 | A | * | 7/2009 |
| KR | 10-1199902 | B1 | | 11/2012 |
| KR | 101213075 | B1 | * | 12/2012 |
| KR | 10-1845355 | B1 | | 4/2018 |

* cited by examiner

LOW-PROFILE BARRIER AND CONSTRUCTING METHOD THEREOF

CROSS-REFERENCE TO RELATED APPLICATION

This application claims priority to Korean Patent Application No. 10-2020-0150027, filed on Nov. 11, 2020, and all the benefits accruing therefrom under 35 U.S.C. § 119, the contents of which in its entirety are herein incorporated by reference.

TECHNICAL FIELD

The present disclosure relates to a low-profile barrier that acts as a boundary structure or a protection structure installed on the road to keep vehicles within the roadway, and a method for constructing the same. The present disclosure relates to a low-profile barrier including a plurality of segments continuously arranged in the longitudinal direction and a method for constructing the same. More particularly, the present disclosure relates to a low-profile barrier having a connection portion between segments, the connection portion configured to bend in the horizontal direction in order to effectively absorb impacts in the event of vehicle collisions, thereby ensuring safety of vehicles and vehicle occupants, and a method for constructing the same.

This disclosure corresponds to the research results of a research project (title: Development of S-BRT Priority Signal and Safety Management Technology) of the Ministry of Land, Infrastructure and Transport (Project No. 1615011569/Management Agency: Korea Agency for Infrastructure Technology Advancement).

BACKGROUND ART

Curbstones are installed on the edges of the roads to separate driveways from pedestrian roads. Additionally, medians may be installed in the middle of roadways to separate lanes. There are structures for defining boundaries at construction zones or intersections on the roads. The curbstones, the medians and the structures for defining boundaries have low heights and extend in the longitudinal direction along the road, and their function is to keep vehicles within the roadways or form boundaries. These structures are referred to as low-profile barriers.

One of the important functions required for the low-profile barriers is to mitigate impacts in the event of vehicle collisions. Korean Patent No. 10-1199902 discloses a connector used to connect curbstones in order to prevent the dislocation of the curbstones in the event of vehicle collisions. However, sufficient impact mitigation cannot be expected from the existing technology.

DISCLOSURE

Technical Problem

The present disclosure is directed to providing a low-profile barrier having a connection portion between segments, the connection portion configured to bend in the horizontal direction in order to effectively absorb impacts in the event of vehicle collisions, thereby ensuring safety of vehicles and vehicle occupants, and a method for constructing the same.

Technical Solution

To achieve the above-described object, the present disclosure provides a low-profile barrier including a plurality of segments made of concrete continuously arranged in the longitudinal direction, and a connecting member installed in a connection portion between the segments to integrally connect the segments.

In particular, the present disclosure provides a low-profile barrier configured such that when a vehicle collision occurs, the body of the connecting member is curved by applied lateral forces, the segments are bent and primary dissipation of vehicle collision energy takes place, and as the body of the connecting member is more curved, a crushable member is compressed and deformed or collapsed and secondary dissipation of collision energy caused by the vehicle collision takes place.

In addition, the present disclosure provides a method for constructing a low-profile barrier including continuously arranging a plurality of segments; and installing a connecting member in a connection portion between the segments to integrally connect the neighboring segments to construct the low-profile barrier according to the present disclosure.

Advantageous Effects

In the low-profile barrier according to the present disclosure, when a vehicle collision occurs, displacement occurs in the connection portion between the segments so that the segments are naturally bent at a predetermined angle, and primary absorption of collision energy takes place. Also, in turn, in the low-profile barrier according to the present disclosure, secondary absorption of collision energy takes place by compressive deformation and collapse of the crushable member in the connection portion between the segments when the vehicle collision occurs.

Accordingly, the low-profile barrier of the present disclosure may absorb the collision energy caused by the vehicle collision very effectively. Additionally, it is possible to reduce impacts applied to vehicle occupants and minimize injuries to vehicle occupants, thereby ensuring safety of the vehicles and vehicle occupants.

BEST MODE

Figure 1:
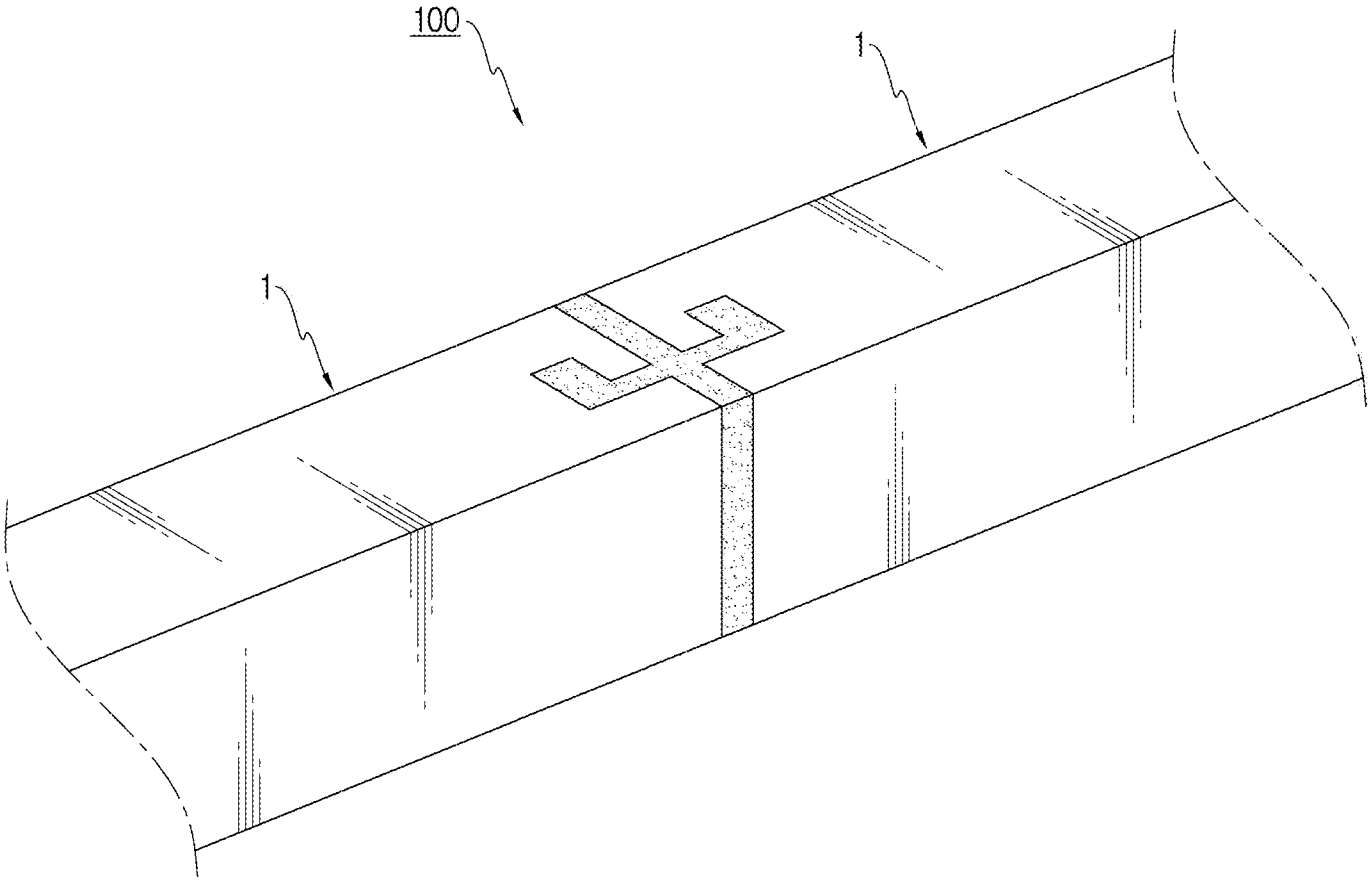
FIG. 1 is a schematic perspective view showing a part of a low-profile barrier including a connection portion according to a first embodiment of the present disclosure.

Hereinafter, preferred embodiments of the present disclosure will be described with reference to the accompanying drawings. Although the present disclosure is described with reference to the embodiments shown in the drawings, it is described as an embodiment, and the technical spirit of the present disclosure and its key configuration and operation are not limited thereto.

Figure 2:
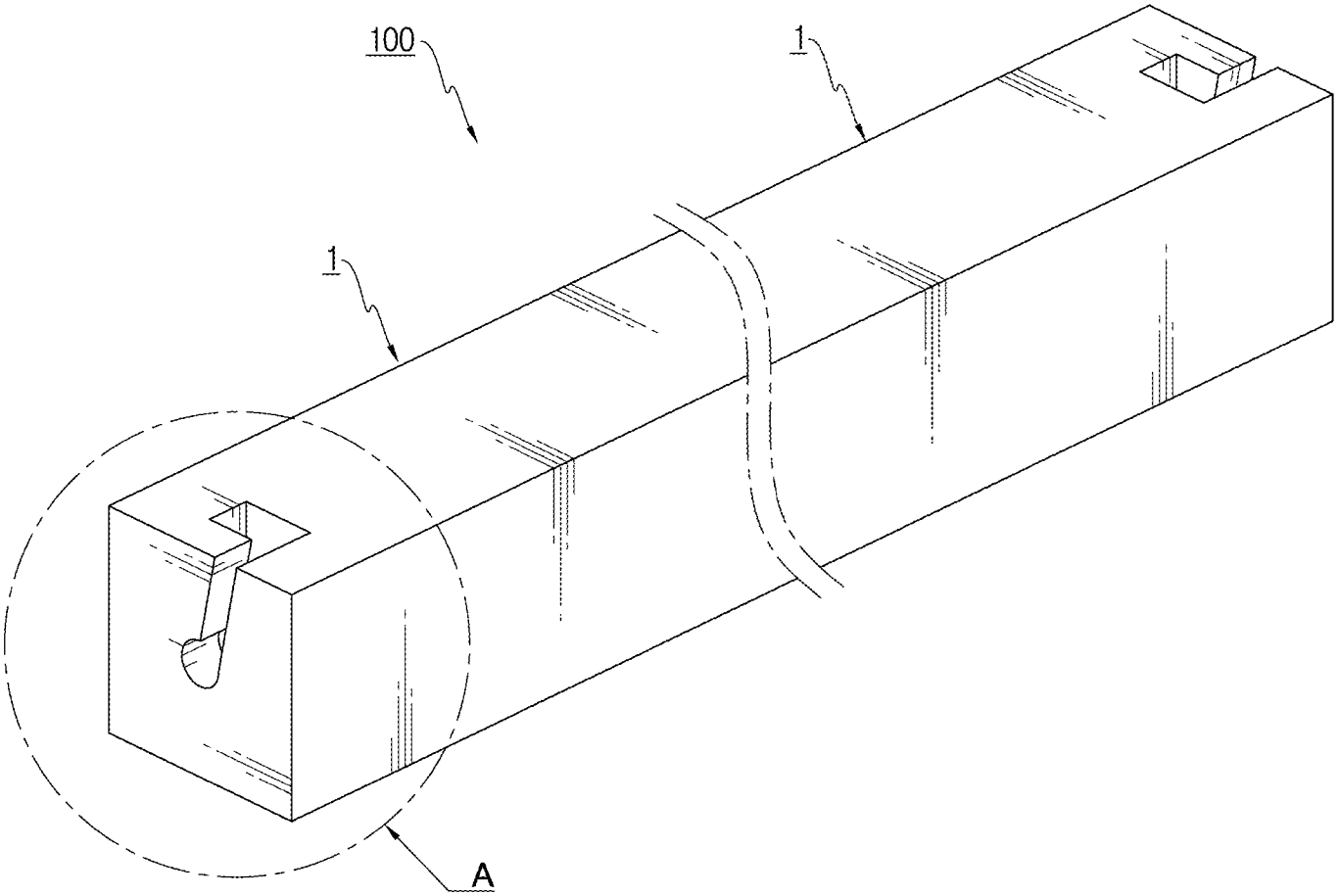
FIG. 2 is a schematic perspective view of a segment of the low-profile barrier of FIG. 1.
Figure 3:
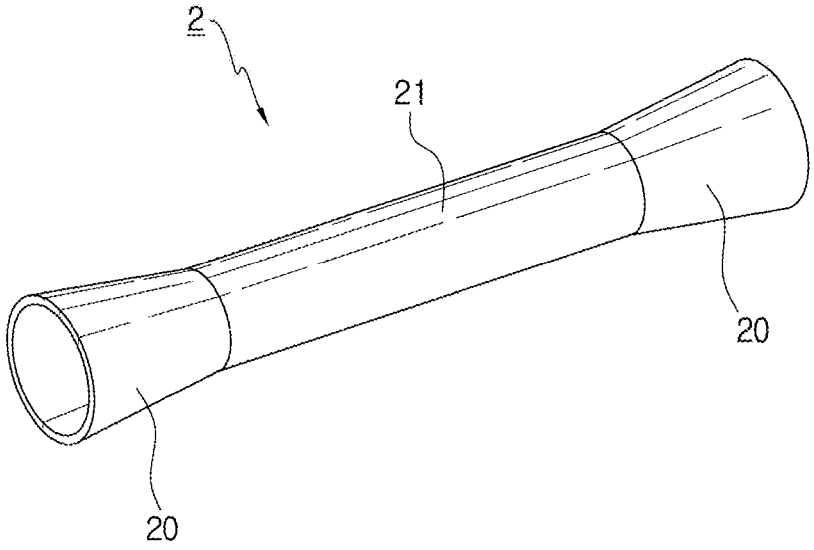
FIG. 3 is a schematic perspective view of a connecting member provided in the present disclosure.

FIG. 1 is a schematic perspective view showing a part of a low-profile barrier 100 including a connection portion having a connection structure configured to bend and absorb impacts according to a first embodiment of the present disclosure. FIG. 2 is a schematic perspective view showing a segment 1 of the low-profile barrier 100 shown in FIG. 1. FIG. 3 is a schematic perspective view of a connecting member 2 provided in the low-profile barrier 100 of the present disclosure.

The low-profile barrier 100 according to the present disclosure includes a plurality of segments 1 made of concrete continuously arranged in the longitudinal direction. In the low-profile barrier 100 of the present disclosure, the connecting member 2 is installed in the connection portion between the segments 1. The connecting member 2 is a bendable member. The connecting member 2 includes a tapered crushable member 20 at the ends. When a vehicle collides with the low-profile barrier 100, the connecting member 2 will be curved, and therefore, the connection portion will be bent, and further, the crushable member 20 will be compressively deformed or crushed. In this process, collision energy caused by the vehicle collision is dissipated, and impacts applied to the vehicle involved in the collision are attenuated.

The connecting member 2 will be described in detail. The connecting member 2 includes a body 21 and the crushable member 20. The body 21 is a rod-shaped member that extends in the longitudinal direction. The body 21 is made of a material that can stretch or shrink and bend in a predetermined range, such as, for example, a strand. The crushable member 20 is integrally provided at each of two ends of the body 21. The crushable member 20 would be a cone-shaped tapered member having a cross-sectional size gradually decreasing toward the center of the body 21. Preferably, the cone-shaped tapered member for the crushable member 20 may be a hollow member. The con-shaped tapered member for the crushable member 20 may be filled with a compressible material.

The segment 1 is a structure that extends in the longitudinal direction. The plurality of segments 1 is continuously arranged in the longitudinal direction to form the low-profile barrier 100 of the present disclosure. The segment 1 may be formed of a reinforced concrete structure. However, the segment 1 is not limited to the reinforced concrete structure.

Figure 4:
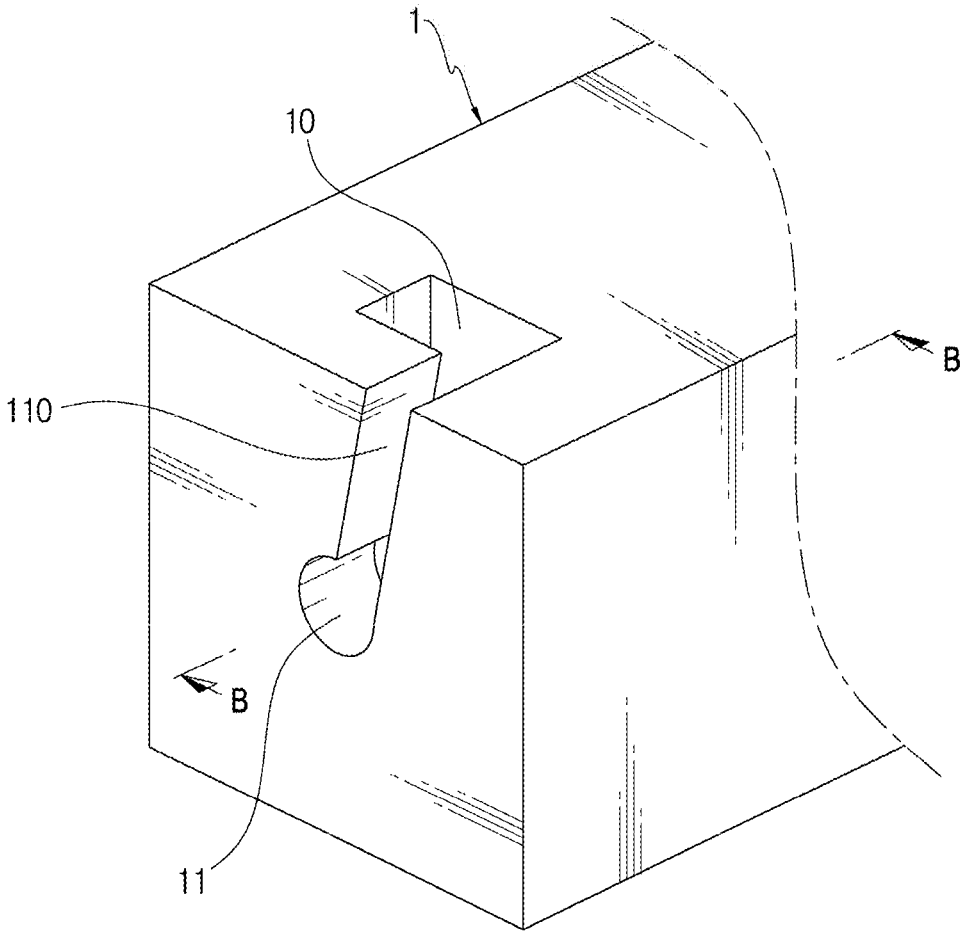
FIG. 4 is a schematic enlarged perspective view of the circle A in FIG. 2 detailing a connection end of the segment shown in FIG. 2.
Figure 5:
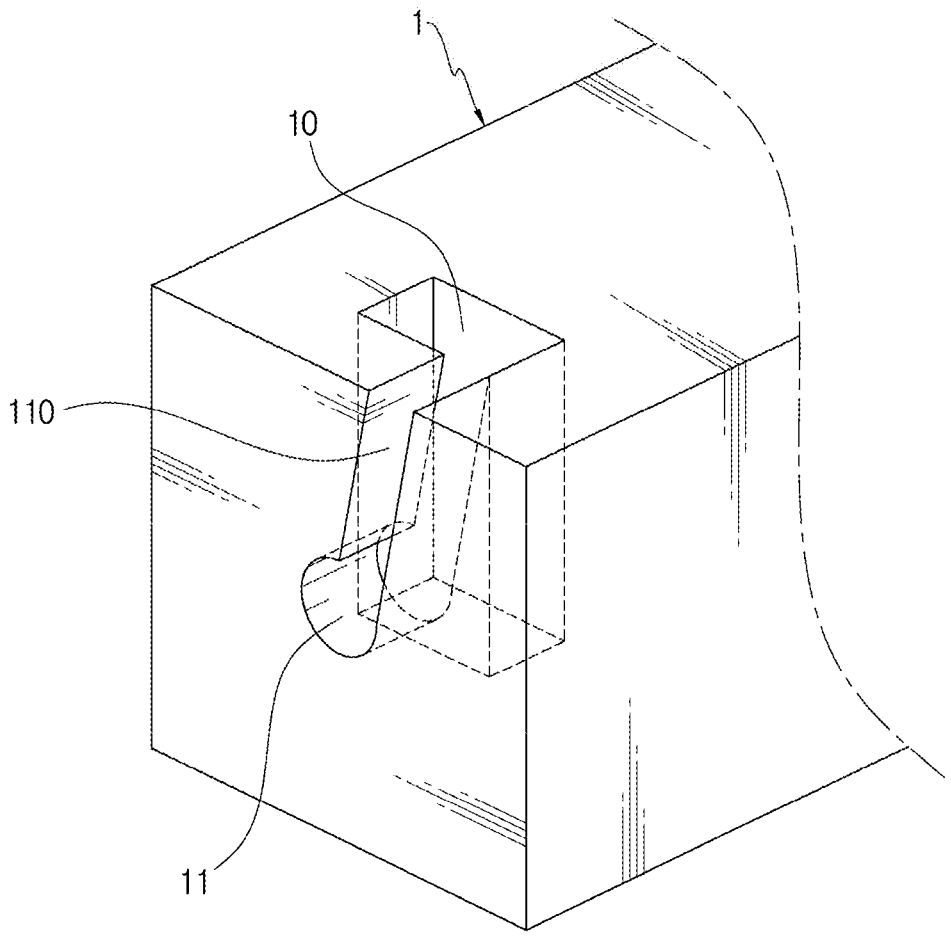
FIG. 5 is a schematic cutaway perspective view detailing an internal configuration of a connection end in FIG. 4.
Figure 6:
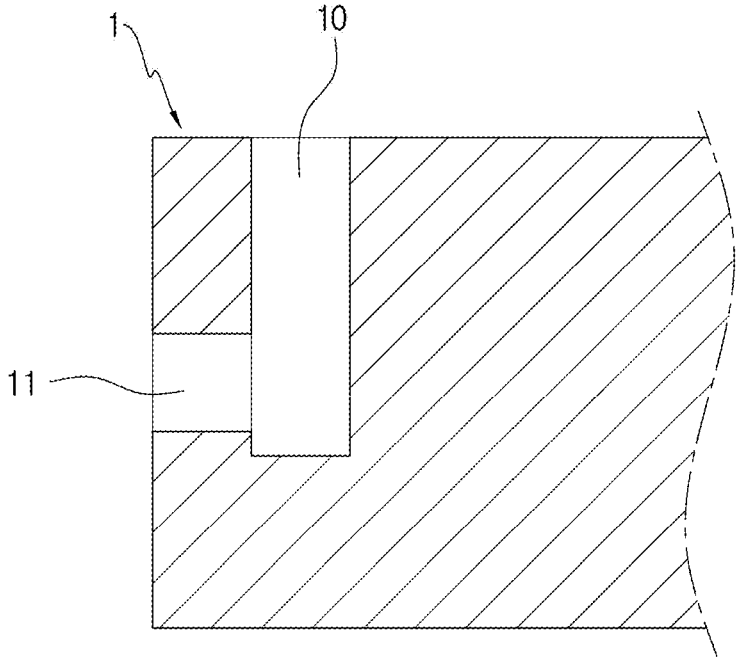
FIG. 6 is a schematic horizontal cross-sectional view taken along the line B-B of FIG. 4.

FIG. 4 is a schematic enlarged perspective view of the circle A in FIG. 2, detailing a connection end of the segment 1 shown in FIG. 2. FIG. 5 is a schematic cutaway perspective view detailing the internal configuration of the connection end in FIG. 4. FIG. 6 is a schematic horizontal cross-sectional view taken along the line B-B of FIG. 4. The connection end of the segment 1 has an insertion space 10.

The insertion space 10 is a space in which the crushable member 20 of the connecting member 2 may be inserted and embedded. A connection end surface of the segment 1 is disposed in front of the insertion space 10. The connection end surface of the segment 1 has a through-hole 11. The through-hole 11 has such a size that allows the body 21 of the connecting member 2 to pass through but disallows the crushable member 20 to pass through. At the connection end of the segment 1, the empty insertion space 10 in which the crushable member 20 may be embedded and disposed in a cross-sectional center of the segment 1 is formed at a location far away from the exposed connection surface. The insertion space 10 is an empty space in which the crushable member 20 may be embedded and disposed in the cross-sectional center of the segment 1. The through-hole 11 is formed between the insertion space 10 and the connection surface of the segment 1 to connect the insertion space 10 to the connection surface of the segment 1. The through-hole 11 may be formed as a hole having a uniform diameter in the longitudinal direction. Additionally, the through-hole 11 may be formed as a tapered hole having the diameter gradually increasing from the connection surface toward the insertion space 10. The tapered shape of the through-hole 11 does not need to match the tapered shape of the crushable member 20. The through-hole 11 has such a diameter that allows the body 21 to pass through but disallows the crushable member 20 to pass through. Accordingly, when the body 21 is pulled as described below, the crushable member 20 gets stuck in the through-hole 11 and its outer surface is compressively deformed, and in some cases, collapse may occur in the crushable member 20 stuck in the through-hole 11.

In the present disclosure, the insertion space 10 continues with the lateral side of the segment 1. Additionally, the through-hole 11 is in communication with the lateral side of the segment 1. The insertion space 10 is open to the lateral side of the segment 1, and the through-hole 11 is open to the lateral side of the segment 1 by an insertion passage 110. Accordingly, as described below, each of the crushable member 20 and the body 21 of the connecting member 2 may be inserted into the insertion space 10 and the through-hole 11 from the lateral side of the segment 1. The insertion passage 110 also continues with the insertion space 10. The insertion space 10 is open to the top lateral side of the segment 1. In the first embodiment of the present disclosure shown in FIGS. 2 and 4 to 6, the insertion passage 110 is in communication with the top lateral side of the segment 1. In this case, the insertion passage 110 preferably extends in the inclined direction as shown in the drawing, not in the longitudinal direction straight from the through-hole 11. When a vehicle collides with the low-profile barrier, vertical forces may be applied to the body 21 of the connecting member 2. In this situation, the insertion passage 110 extending in the inclined direction as shown in the drawing is more advantageous to preventing the body 21 from easily slipping out of the through-hole 11. In the first embodiment of the present disclosure shown in FIGS. 2 and 4 to 6, the insertion space 10 is open to the top lateral side of the segment 1. Additionally, in the first embodiment of the present disclosure, the insertion passage 110 is continuous with the top lateral side of the segment 1. However, the direction in which the insertion space 10 is open and the direction in which the insertion passage 110 is continues may change.

Figure 7:
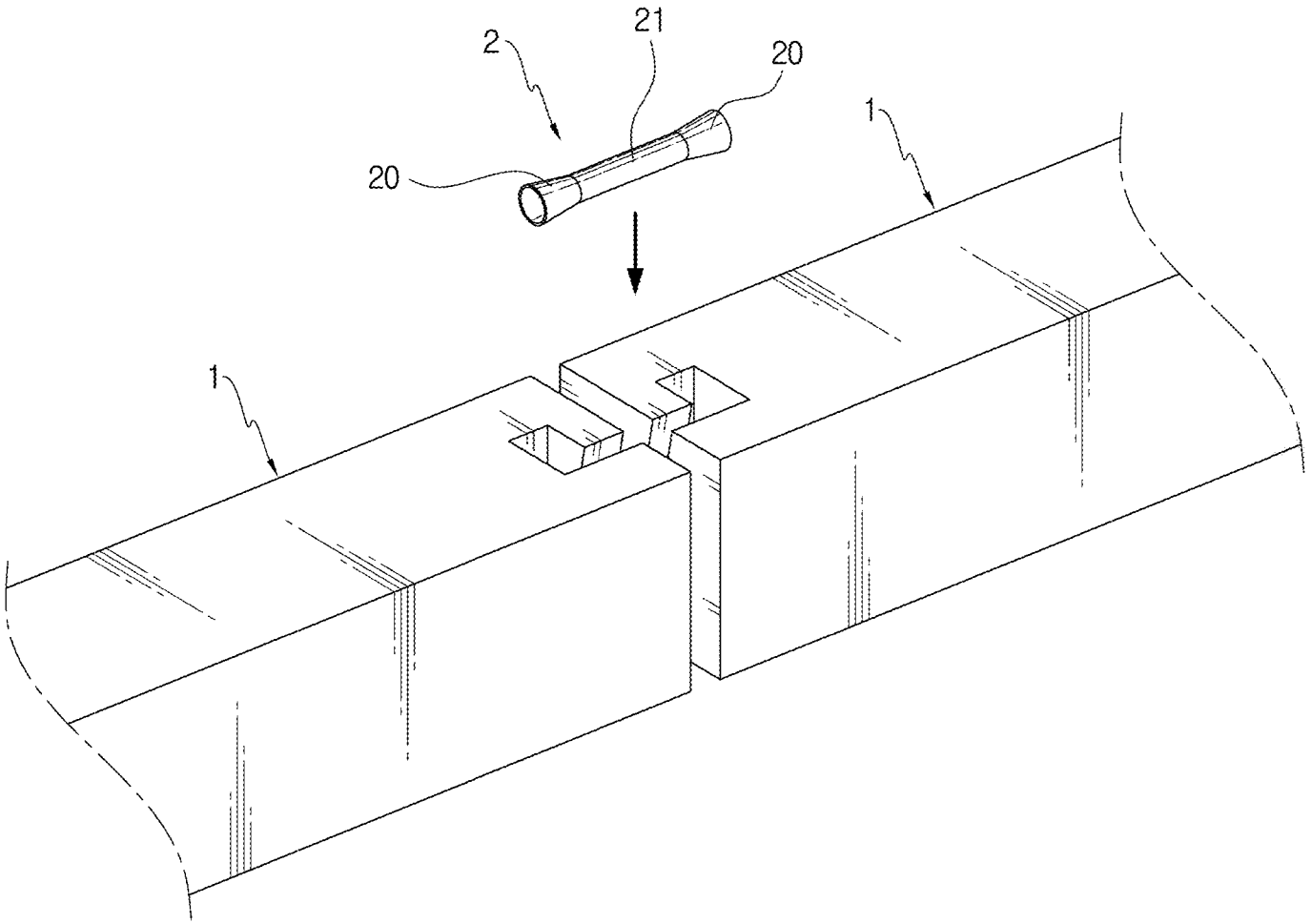
FIG. 7 is a schematic perspective view showing two segments continuously arranged and a connecting member that is installed in a connection portion between the two segments in a first embodiment of the present disclosure.
Figure 8:
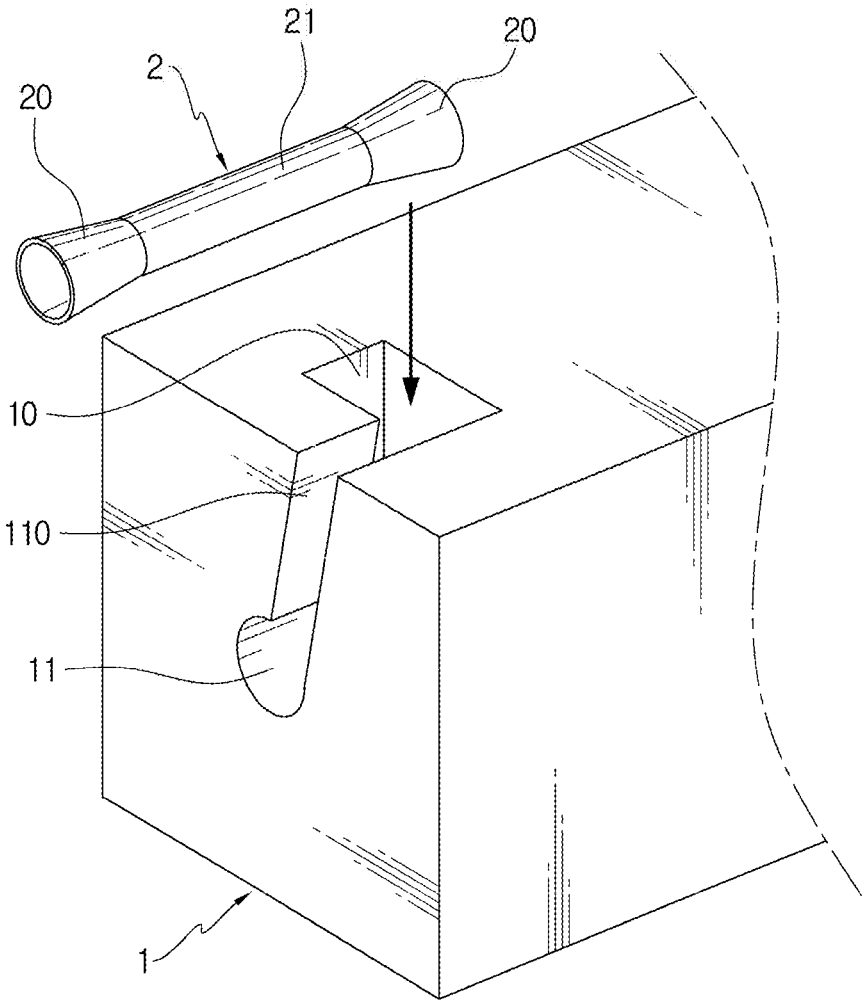
FIGS. 8 and 9 are schematic perspective views showing a connection end of a segment on one side to sequentially show a process of installing a connecting member in a first embodiment of the present disclosure.
Figure 9:
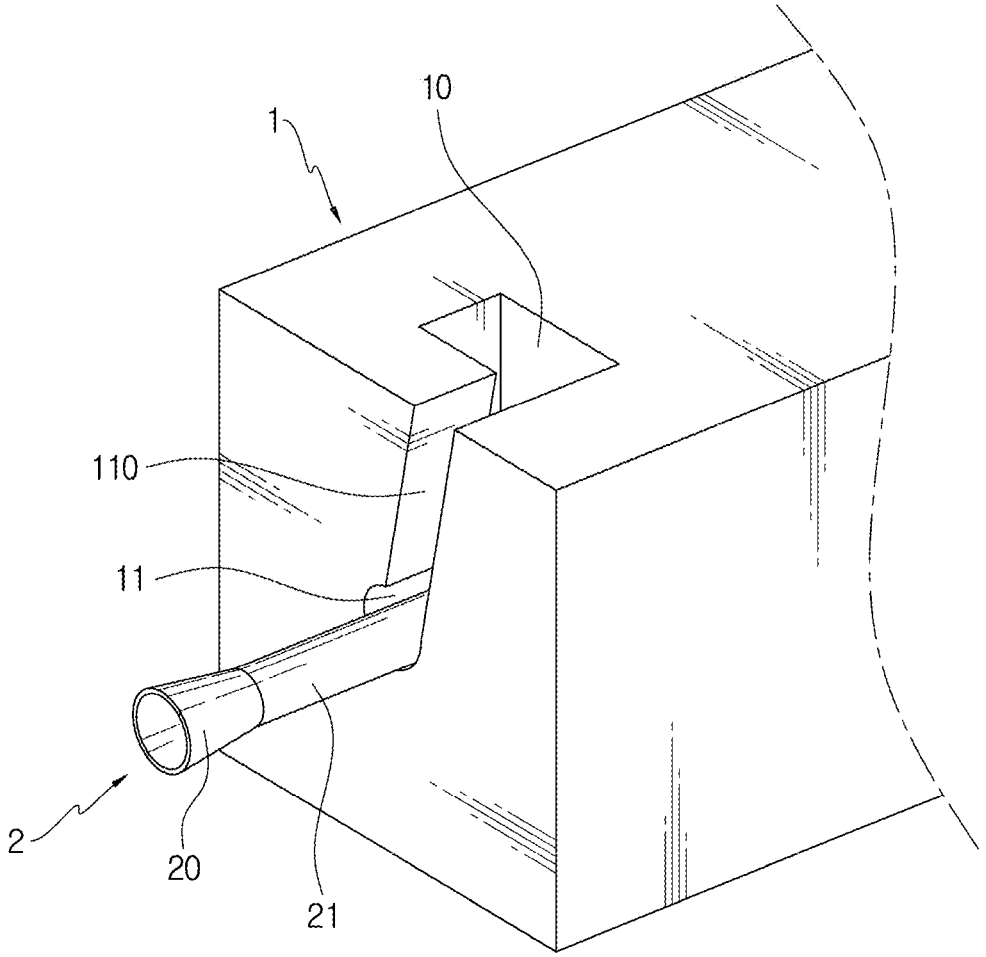
Figure 10:
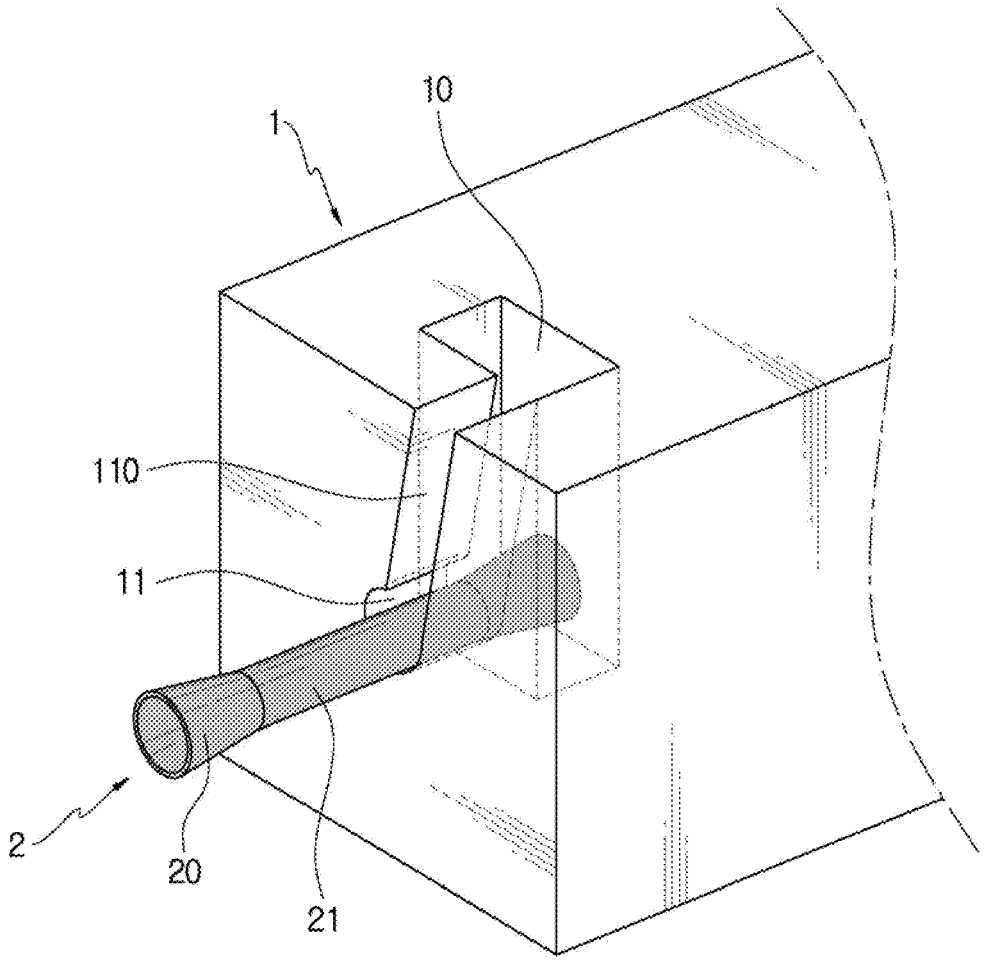
FIG. 10 is a schematic cutaway perspective view corresponding to FIG. 5 detailing an internal configuration of a connection end in the state shown in FIG. 9.

FIG. 7 is a schematic perspective view showing two segments 1 continuously arranged and the connecting member 2 installed in the connection portion between the segments 1 in the first embodiment of the present disclosure. FIGS. 8 and 9 are schematic perspective views corresponding to FIG. 4 for sequentially showing the process of installing the connecting member 2. FIGS. 8 and 9 show the connection end of the segment 1 on one side in FIG. 7, and for convenience, the segment on the other side is omitted. FIG. 10 is a schematic cutaway perspective view corresponding to FIG. 5 detailing the internal configuration of the connection end in the state shown in FIG. 9.

In the construction method according to the present disclosure, first, each segment 1 having the above-described connection end configuration is prepared. Subsequently, as shown in the drawing, the segments 1 are continuously arranged in the longitudinal direction such that the connection surfaces of the segments 1 face each other. Subsequently, the connecting member 2 is installed in the connection portion between the segments 1. In this instance, the connection ends of the segments 1 facing each other have a symmetrical configuration. The connection surfaces may be in contact with each other, or may be spaced apart from each other. In the case of the segment 1 according to the first embodiment of the present disclosure, the insertion space 10 is open to the top lateral side of the segment 1 at the connection end. Additionally, in the segment 1 according to the first embodiment of the present disclosure, the insertion passage 110 is also in communication with the top lateral side of the segment 1. Accordingly, the connecting member 2 is inserted and installed downward from the top lateral side of the segment 1. Each of the crushable members 20 provided at two ends of the connecting member 2 is disposed in the insertion space 10 through the top lateral side of the segment 1. The body 21 is inserted into the insertion passage 110 through the top lateral side of the segment 1, moved down and disposed in the through-hole 11. FIGS. 8 and 9 show only the connection end of the segment 1 on one side in which the connecting member 2 is installed. The crushable member 20 and the body 21 are also installed with mirror symmetry at the connection end of the segment on the opposite side. After the connecting member 2 is installed, the insertion space 10 and the insertion passage 110 may be filled with a filler such as mortar. Since the present disclosure places the connecting member 2 downward from the top lateral side of the segment 1 as described above, it is very easy to insert and install the connecting member 2. Accordingly, the outstanding construction efficiency is provided. Further, the connecting member 2 is easy to replace, so it is very advantageous in terms of maintenance and management.

When a vehicle collision occurs on the lateral side of the low-profile barrier 100 of the present disclosure, the connection portion is bent, and at the same time, the crushable member 20 is compressed and/or crushed. Thereby, collision energy caused by the vehicle collision is dissipated, and accordingly impacts applied to the vehicle involved in the collision are attenuated.

Figure 11:
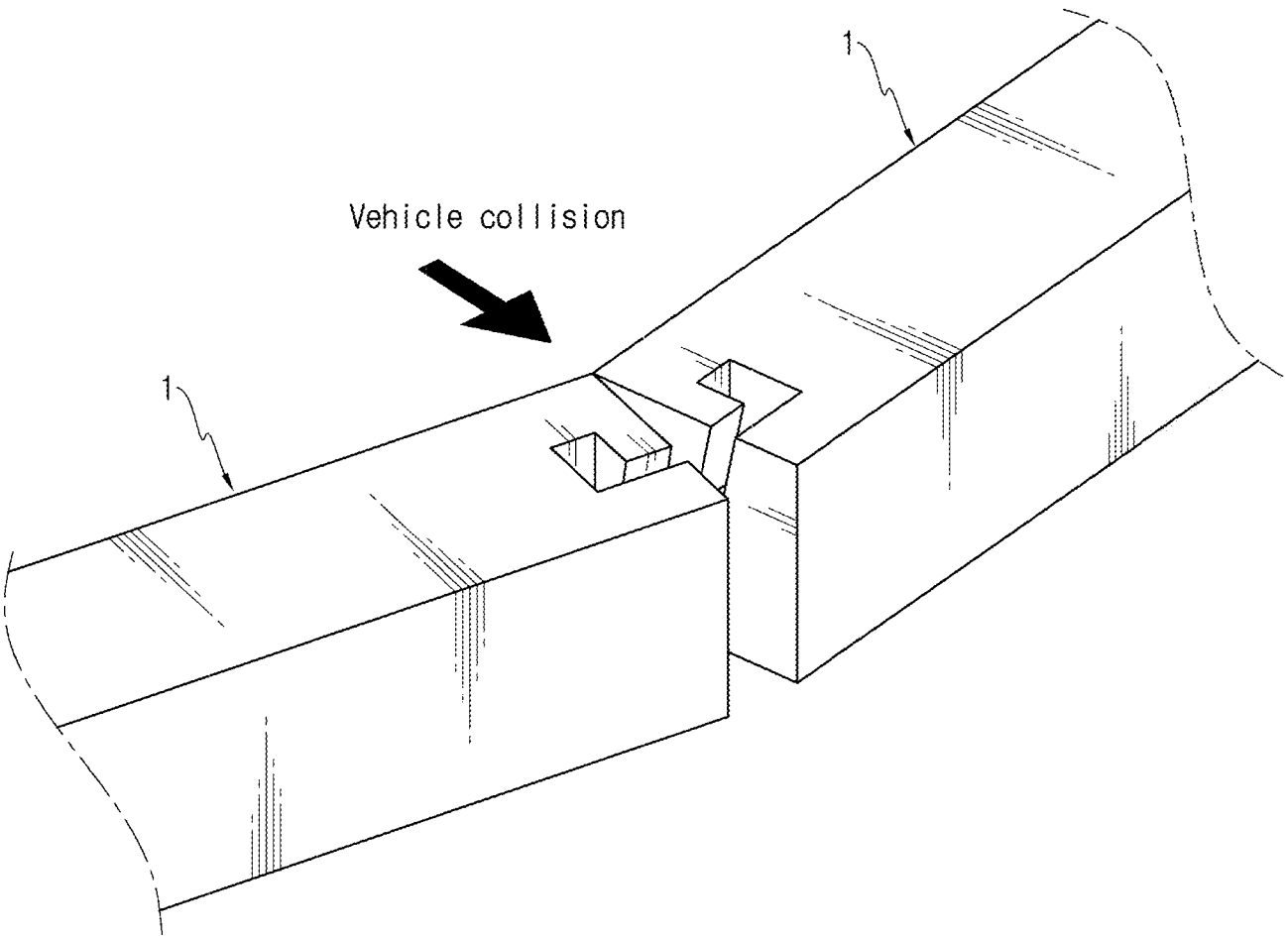
FIG. 11 is a schematic perspective view showing a bent connection portion between two segments due to a vehicle collision.
Figure 12:
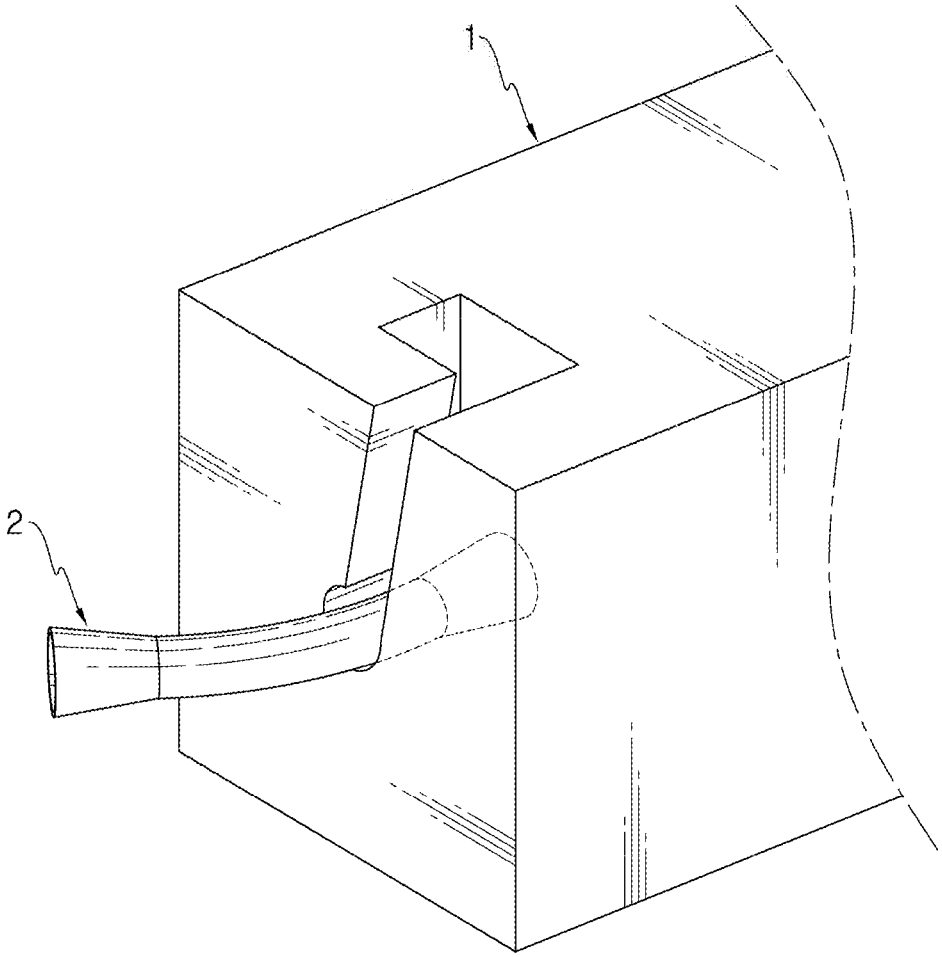
FIG. 12 is a schematic perspective view corresponding to FIG. 4 showing a state of a connecting member in the event of a vehicle collision.
Figure 13:
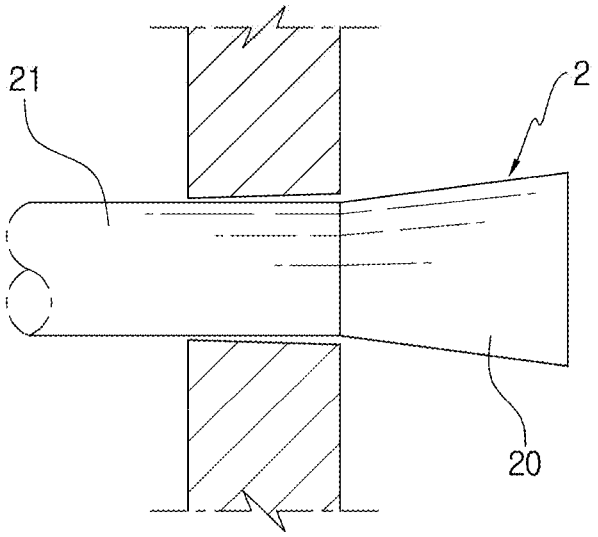
FIGS. 13 and 14 are schematic horizontal cross-sectional views of the proximity of a through-hole, showing compression of a crushable member in a connection end of a segment in the event of a vehicle collision.
Figure 14:
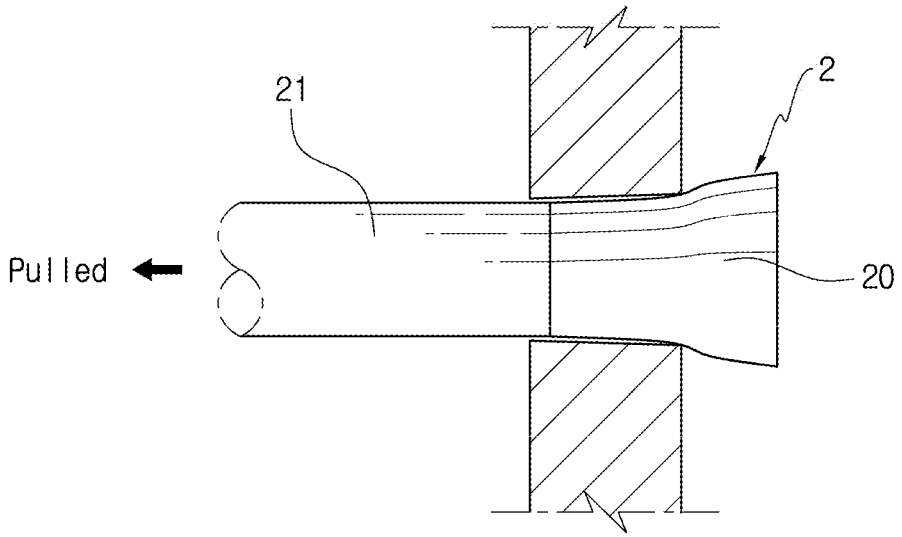

FIG. 11 is a schematic perspective view showing the bent connection portion between the two segments 1 due to a vehicle collision. FIG. 12 is a schematic perspective view corresponding to FIG. 4 showing a state of the connecting member 2 in the event of a vehicle collision. FIGS. 13 and 14 are schematic horizontal cross-sectional view of the proximity of the through-hole, sequentially showing the compression of the crushable member 20 in the connection end of the segment 1 in the event of a vehicle collision.

The body 21 of the connecting member 2 is made of a bendable material such as a strand. Accordingly, when a vehicle collides with the low-profile barrier 100 of the present disclosure, the connecting member 2 curves, and accordingly, each neighboring segment 1 is subjected to displacement at an angle, and the connection portion is bent. In this process, primary dissipation of collision energy caused by the vehicle collision takes place. In this instance, as the body 21 curves, the crushable member 20 is pulled toward the connection surface and then gets stuck in the through-hole 11. In case that a part of the crushable member 20 is already stuck in the through-hole 11, as the body 21 curves, the crushable member 20 gets stuck in the through-hole 11 more deeply. In this process, large resistive forces against the lateral forces caused by the vehicle collision are generated.

When the lateral forces caused by the vehicle collision are continuously applied, the body 21 is more curved and the crushable member 20 further gets stuck in the through-hole 11. Since the diameter of the through-hole 11 is small enough to prevent the crushable member 20 from slipping out of the through-hole 11, as the crushable member 20 gets stuck in the through-hole 11, its outer surface is compressed and deformed, and in a more serious case, the crushable member 20 is crushed. In this process, secondary dissipation of collision energy caused by the vehicle collision takes place, and accordingly impacts applied to the vehicle involved in the collision are greatly attenuated. As a result, it is possible to ensure safety of vehicle occupants.

The through-hole 11 may be formed in the shape of a tapered hole of which the diameter gradually increases from the connection surface toward the insertion space 10. In this case, when the crushable member 20 is inserted into the through-hole 11, compressive deformation and crush of the crushable member 20 does not rapidly take place and gradually progresses. Accordingly, secondary dissipation of collision energy also gradually progresses, resulting in the enhanced shock attenuation effect. That is, after the vehicle collision, the crushable member 20 is slowly compressively deformed and crushed, thereby stopping the vehicle slowly and safety without large impacts applied to occupants in the vehicle involved in the collision.

Figure 15:
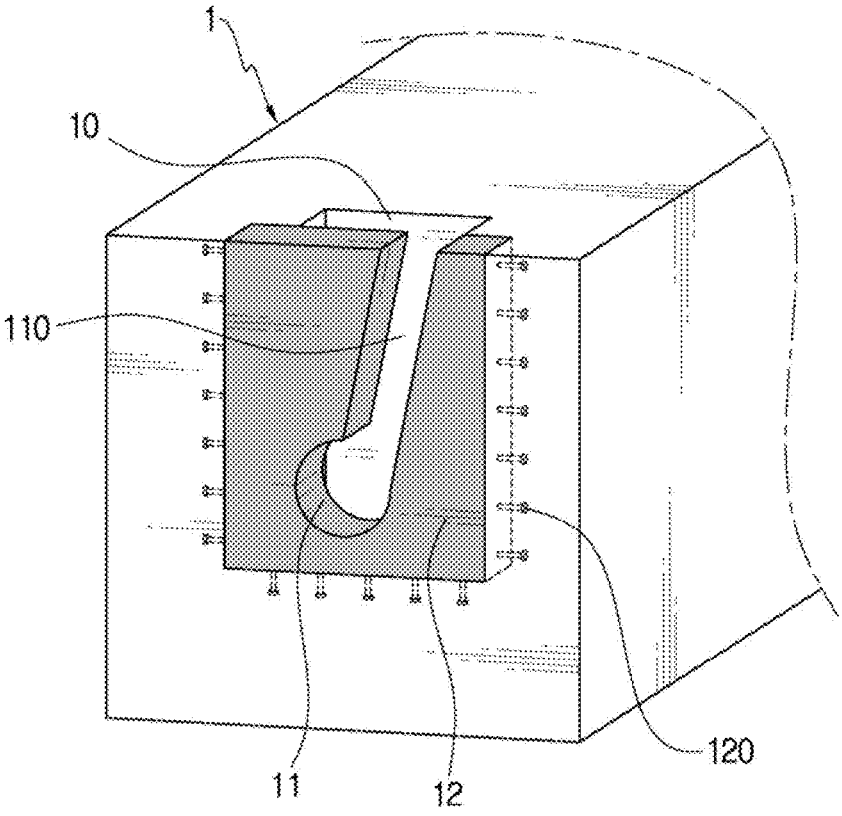
FIG. 15 is a schematic cutaway perspective view showing a connection end of a segment having a reinforcement plate installed to form a part of a connection surface according to a second embodiment of the present disclosure.

As described above, when stuck in the through-hole 11, the crushable member 20 exerts resistive forces and is compressively deformed and collapsed, so the through-hole 11 and its proximity need to have sufficient robustness. Accordingly, if necessary, a part or all of the connection surface of the segment 1 may be formed using a separate member such as a reinforcement plate having the through-hole 11. FIG. 15 is a schematic cutaway perspective view showing the connection end of the segment 1 in a second embodiment of the present disclosure. The segment 1 according to the second embodiment of FIG. 15 includes the reinforcement plate 12 made of steel having the through-hole 11 and the insertion passage 110 to form a part of the connection surface. When the segment 1 is made of concrete, in installing the reinforcement plate 12, an embed protrusion 120 such as a stud may be formed around the reinforcement plate 12 for more firm integration with the concrete of which the segment 1 is made. In this case, the embed protrusion 120 is embedded in the concrete. The insertion passage 110 may be formed in the reinforcement plate 12. The material of the reinforcement plate 12 is not limited to steel. The reinforcement plate 12 may be integrated with the surrounding concrete of which the connection surface of the segment 1 is made. In contrast, the reinforcement plate 12 may be completely embedded in the concrete, and further, may be attached to the exterior of the concrete.

Figure 16:
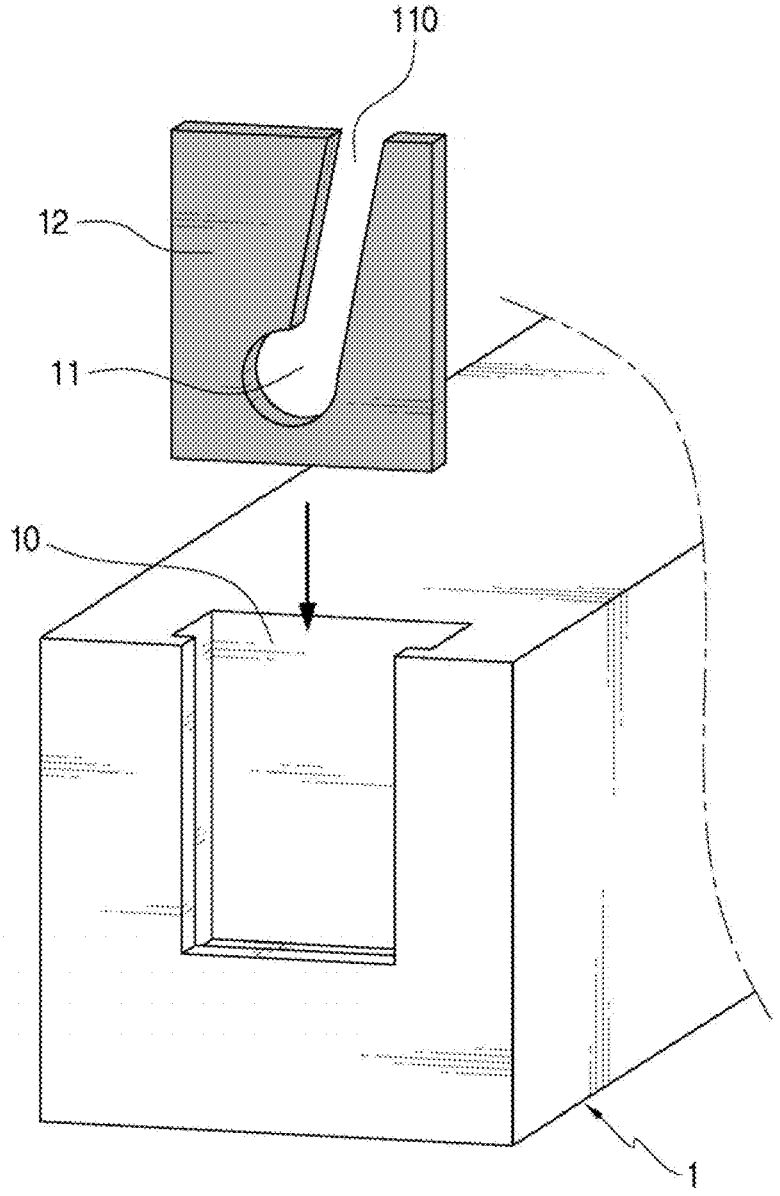
FIGS. 16 and 17 are schematic perspective views sequentially showing a process of installing a separate reinforcement plate in a connection end of a segment by another method.
Figure 17:
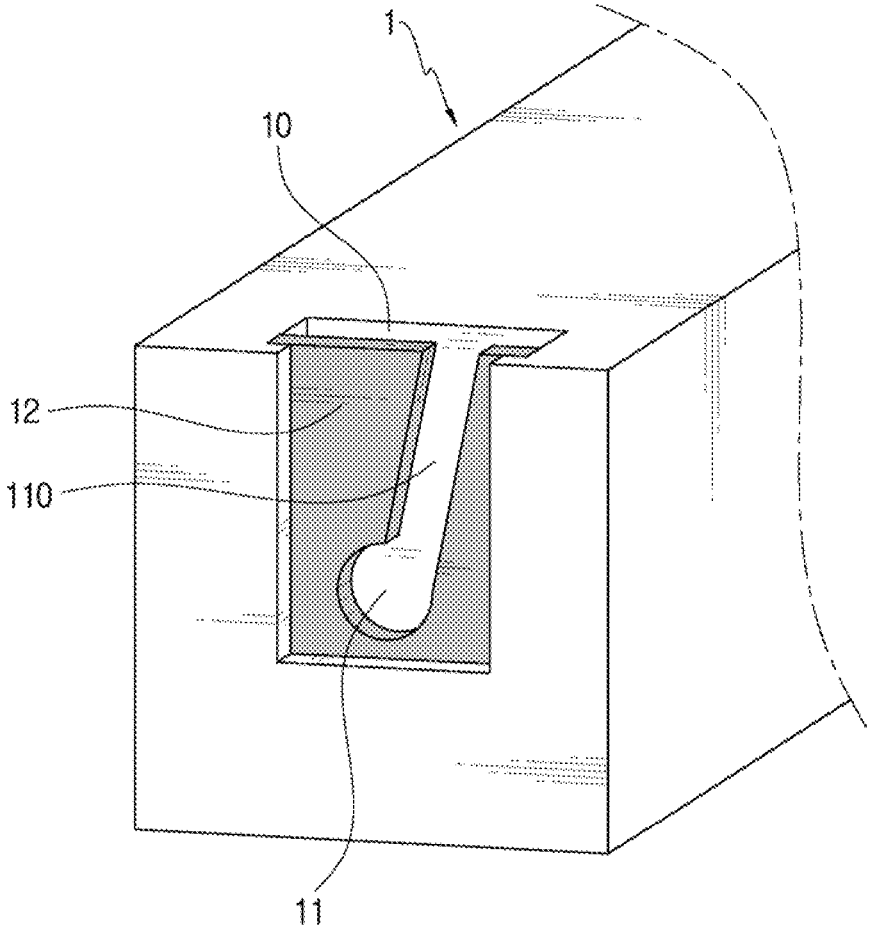

In particular, in using the separate reinforcement plate 12 having the through-hole 11, another method may be used, not embedding in the concrete of the segment 1. FIGS. 16 and 17 are schematic perspective views sequentially showing the process of installing the separate reinforcement plate 12 in the connection end of the segment 1 by another method. As shown in FIGS. 16 and 17, the method may be performed by opening one side of the insertion space 10 in the connection end of the segment 1, and installing the separate reinforcement plate 12 having the through-hole 11 and the insertion passage 110 in the opening of the insertion space 10.

As described above, in the case of the low-profile barrier 100 according to the present disclosure, when a vehicle collision occurs, dislocation occurs in the connection portion so that the segments 1 are naturally bent at a predetermined angle and primary absorption of collision energy takes place. At the same time, secondary absorption of collision energy takes place by compressive deformation or crush of the crushable member 20. Accordingly, it is possible to absorb the collision energy caused by the vehicle collision very effectively, and accordingly reduce impacts applied to vehicle occupants and minimize injuries to the vehicle occupants.

In the present disclosure, the connecting member 2 is easy to replace and its installation task can be performed in a straightforward manner. Accordingly, it is possible to recover the low-profile barrier quickly by replacing only the connecting member 2 after a vehicle collision.

The invention claimed is:

1. A low-profile barrier, comprising:

a plurality of segments continuously arranged, and a connecting member which is installed in a connection portion between the segments to integrally connect the neighboring segments, wherein the connecting member includes a bendable body, and a crushable member formed of a cone-shaped tapered member and integrally provided at each of two ends of the body, a connection end of the segment has an insertion space in which the crushable member is inserted and embedded, the insertion space being open to a lateral side of the segment, a connection surface of the segment in front of the insertion space has a through-hole through which the body of the connecting member passes, the through-hole being in communication with the insertion space, and the through-hole is in communication with the lateral side of the segment by an insertion passage, the insertion space is open to a top lateral side of the segment, the insertion passage extends with a slope toward the top lateral side of the segment and is in communication with the top lateral side of the segment, when the segments are continuously arranged with the connection surfaces facing each other, the crushable member is disposed in the insertion space through the lateral side of each of the segments on two sides, and the connecting member is installed such that the body is inserted into the insertion passage through the lateral sides of the segments on the two sides and disposed in the through-hole, and when a vehicle collision occurs, the connecting member curves, the neighboring segments are bent to form an angle between, primary dissipation of vehicle collision energy takes place, and as the crushable member gets stuck in the through-hole, an outer surface of the crushable member is compressed and deformed or crushed, and secondary dissipation of vehicle collision energy takes place.

2. The low-profile barrier according to claim 1, wherein the segment is made of concrete, a reinforcement plate is installed in the connection surface of the segment disposed in front of the insertion space such that the reinforcement plate is integrated with the concrete, and the through-hole and the insertion passage are formed in the reinforcement plate.

3. A method for constructing a low-profile barrier, comprising:

continuously arranging a plurality of segments; and installing a connecting member in a connection portion between the segments to integrally connect the neighboring segments, wherein the connecting member includes a bendable body, and a crushable member formed of a cone-shaped tapered member and integrally provided at each of two ends of the body, a connection end of the segment has an insertion space in which the crushable member is inserted and embedded, the insertion space being open to a lateral side of the segment, a connection surface of the segment in front of the insertion space has a through-hole through which the body of the connecting member passes, the through-hole being in communication with the insertion space, and the through-hole is in communication with the lateral side of the segment by an insertion passage, the insertion space is open to a top lateral side of the segment, the insertion passage extends with a slope toward the top lateral side of the segment and is in communication with the top lateral side of the segment, and in the step of installing the connecting member, when the segments are continuously arranged with the connection surfaces facing each other, the crushable member is disposed in the insertion space through the lateral side of each of the segments on two sides, and the body is inserted into the insertion passage through the lateral sides of the segments on the two sides and disposed in the through-hole, thereby constructing the low-profile barrier configured such that when a vehicle collision occurs, the connecting member curves, the neighboring segments are bent to form an angle between, primary dissipation of vehicle collision energy takes place, and as the crushable member gets stuck in the through-hole, an outer surface of the crushable member is compressed and deformed or crushed, and secondary dissipation of vehicle collision energy takes place.

4. The method for constructing a low-profile barrier according to claim 3, wherein the segment is made of concrete, a reinforcement plate is installed in the connection surface of the segment disposed in front of the insertion space such that the reinforcement plate is integrated with the concrete, and the through-hole and the insertion passage are formed in the reinforcement plate.

* * * * *